US005132999A

United States Patent [19]

Wirth

[11] Patent Number: 5,132,999

[45] Date of Patent: Jul. 21, 1992

[54] INDUCTIVE X-RAY TUBE HIGH VOLTAGE TRANSIENT SUPPRESSION

[75] Inventor: William F. Wirth, Sullivan, Wis.

[73] Assignee: General Electric Company, Milwaukee, Wis.

[21] Appl. No.: 647,872

[22] Filed: Jan. 30, 1991

[51] Int. Cl.[5] ..... H05G 1/10; H05G 1/06

[52] U.S. Cl. ..... 378/101; 378/91; 378/194; 361/58; 333/33; 363/68

[58] Field of Search ..... 378/91, 92, 101, 102, 378/109, 111, 117, 118, 5, 105, 194; 361/56, 58, 89, 91, 111; 363/68; 333/33

[56] References Cited

U.S. PATENT DOCUMENTS

| | | | |
|---|---|---|---|
| 2,341,932 | 2/1944 | MacCarthy | 361/111 |
| 3,197,719 | 7/1965 | Wells . | |
| 3,325,645 | 6/1967 | Splain . | |
| 3,372,285 | 3/1968 | Blazek et al. | 351/56 |
| 3,636,355 | 1/1972 | James et al. | 378/101 |
| 3,668,465 | 6/1972 | Evans et al. | 315/107 |
| 3,846,633 | 11/1974 | Romandi | 378/101 |
| 3,978,339 | 8/1976 | Alchinger | 378/101 |
| 4,095,163 | 6/1978 | Montague | 361/111 |
| 4,152,743 | 5/1979 | Comstock | 361/111 |
| 4,191,986 | 3/1980 | ta Huang et al. | 361/58 |
| 4,288,700 | 9/1981 | Grass et al. | 378/194 |
| 5,008,912 | 4/1991 | Farrall et al. | 378/91 |
| 5,008,913 | 4/1991 | Negle | 378/91 |

*Primary Examiner*—Janice A. Howell
*Assistant Examiner*—Kim-Kwok Chu
*Attorney, Agent, or Firm*—Quarles & Brady

[57] ABSTRACT

An X-ray imaging system includes an vacuum tube, which is biased by a high voltage power supply connected to the tube by two shielded cables. The cables collectively have a plurality of conductors which are coupled at one end to the high voltage power supply. The other end of each conductor is coupled to a component of the vacuum tube by a separate inductor. During a voltage breakdown of the vacuum tube, the inductors depress electrical current flow between the anode and the cathode of the tube to reduce the erosion of tube components which results from the discharge. This current is in part due to the energy stored in the cable, which is not depressed by conventional current limiting circuits in the high voltage power supply. Voltage limiting devices connected to the tube prevent ringing in the cables from generating excessively high voltage levels.

13 Claims, 1 Drawing Sheet

INDUCTIVE X-RAY TUBE HIGH VOLTAGE TRANSIENT SUPPRESSION

BACKGROUND OF THE INVENTION

The present invention relates to X-ray imaging apparatus, and more specifically to means for depressing transient current surges through an X-ray tube of the apparatus and for reducing radio frequency emissions produced by such current surges.

The X-ray imaging apparatus includes a vacuum tube with a cathode and anode that emits X-rays during operation. The cathode comprises tungsten thermionic emitting source and focusing surfaces. The cathode is part of an assembly which includes a filament to heat the cathode to an operating temperature. Upon application of a potential across the electrodes of the X-ray tube, thermionically emitted electrons traverse the vacuum gap between the cathode and anode, impacting the anode thereby generating X-rays.

A major problem during the operation of X-ray tubes is high voltage discharge or arcing between the electrodes due to intense electric field gradients caused by contamination or rough edges on the surfaces of the electrodes. These discharges, commonly known as "spits", cause radiated and conducted electrical noise of great intensity which can interfere with the operation of electronic circuitry in the vicinity of the tube. In extreme cases, electrical noise from the spits even causes failure of semiconductor devices in adjacent equipment.

A newly manufactured tube is subject to frequent and prolonged spitting which must be greatly reduced in order to be a usable product. Each time a spit occurs, some material around the point that caused the intense field gradient is vaporized. As part of the manufacturing process, a new X-ray tube is "seasoned" by allowing spits to smooth the electrodes by vaporizing any foreign particles and surface roughness that can cause intense field gradients.

The seasoning process is affected by the energy available to vaporize the material and by the way the energy is delivered to the discharge arc. If too much energy is delivered, the imperfection is vaporized along with underlying material, sometimes forming a crater whose rim may have edges sharp enough to cause additional spits and more extensive erosion of the electrode. In conventional seasoning the energy available to the spit is determined by the voltage and capacitance of the high voltage cables feeding the tube and is typically in the range of tens of joules. The current is determined by the voltage and characteristic impedance of the cables and can be one thousand amperes or more.

A limiting resistor has been connected in series with the anode of the tube to try to control the peak current of the discharge. A problem with this technique is that the stored energy in the high voltage cables is discharged into both the arc and the resistor in an uncontrolled ratio. The resistor and the arc are in series and thus have the same current. The arc has a hyperbolic negative resistance volt-ampere characteristic and the resistor has a linear positive resistance characteristic which results in the two sharing the source voltage and power in an unstable, oscillatory manner. The energy that actually is delivered to the vaporization process is somewhat random and difficult to control with a resistor.

Even when an X-ray tube is properly seasoned during manufacture, these discharges occasionally occur while the tube is operating in an imaging apparatus. The discharges shorten the life of the tube, as well as producing electrical noise. The discharges become more and more frequent as the tube nears the end of its useful life and is one of its major failure modes.

SUMMARY OF THE INVENTION

An X-ray imaging apparatus includes a vacuum tube having a cathode and anode for the production of an X-ray beam. The apparatus further includes a source for generating and maintaining a high voltage potential during the operation of the X-ray tube.

In the preferred embodiment, the source preferably has separate high voltage power supplies for the anode and cathode electrodes of the tube. The X-ray tube is electrically connected to the source by high voltage cables, one connecting the anode power supply to the anode of the X-ray tube and another connecting the cathode power supply to the cathode of the tube. Separate inductive elements couple each cable conductor to the X-ray tube components. The inductive element suppresses transient currents flowing from the anode and cathode cables into the X-ray tube during a discharge spit and reduces the emission of radio frequency signals therefrom.

The inductive elements are used not only during the seasoning process, but preferably remain in the X-ray tube circuit after it has been placed into service. The continued use of the inductors prevents occasional spits, caused by particles attracted to electrodes by the intense electric fields and by the sharp electrode edges, from cracking and otherwise damaging of the X-ray tube electrodes. If the imaging apparatus includes these inductive elements, normal spitting is controlled, prolonging the useful operating life of the tube.

Heretofore, it was a generally accepted practice to minimize inductance coupled in series with the cable. Such inductance interacts with the intrinsic capacitance of the cable to produce ringing which can double the voltage on the cable. As the anode to cathode voltage already is extremely high, 40,000 to 150,000 volts, the ringing can cause a breakdown of the cable insulation as well as damage components connected to the cable. To reduce the ringing voltage, should it present a problem, a voltage limiting device may be connected to each inductive element.

The object of the present invention is to limit the current flow through an X-ray tube during a breakdown discharge, enabling the X-ray tube to return to a dielectric condition required for further operation.

Another object is to provide a mechanism between the X-ray tube and cables from the high voltage source which restricts energy stored in the cables from producing breakdown current of such high magnitude as to damage tube components.

A further object is to incorporate an element in that mechanism which limits the voltage produced by ringing in the cable and tube combination.

Yet another object is to suppress high frequency signals produced within the X-ray tube during a breakdown discharge from being carried by the cables.

DETAILED DESCRIPTION OF THE INVENTION

Figure 1:
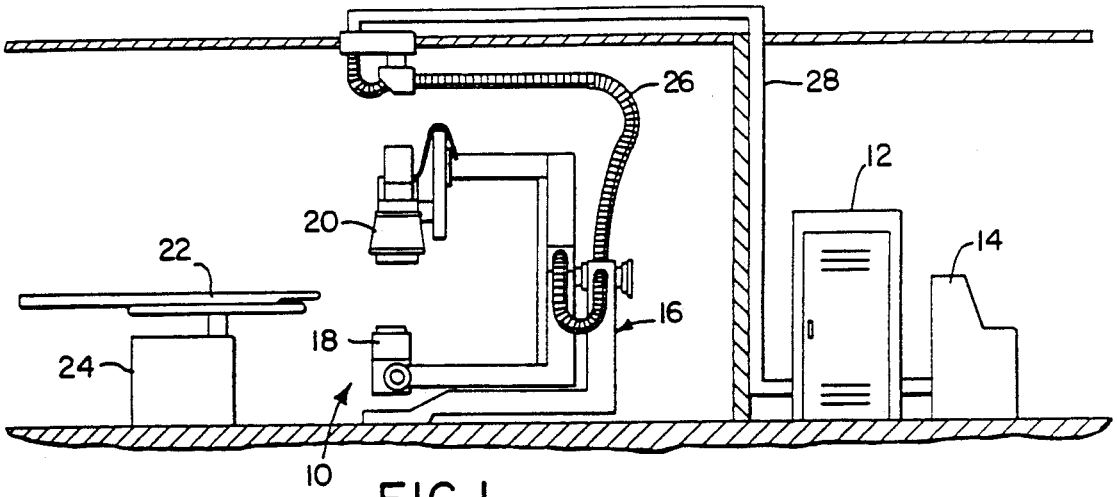
FIG. 1 is a pictorial representation of an X-ray imaging apparatus incorporating the present invention.

With initial reference to FIG. 1, an X-ray imaging apparatus, generally designated as 10, is illustrated installed in two rooms of a building, such as a hospital or medical clinic. Within one room is a power supply 12 and an X-ray control console 14. As will be described, the power supply 12 typically includes several low voltage supplies and a high voltage supply. Within the other room is a gantry arrangement 16 on which the X-ray tube assembly 18 and X-ray detection assembly 20 are mounted. The X-ray detection assembly 20 consists of a film holder and a video camera, or in the case of computed tomography an X-ray detector which converts X-ray intensity into electrical signals. Electrical cables, that transfer power and control signals, extend through a flexible conduit 26 and a rigid conduit 28 from the components mounted on the gantry 16 to the power supply 12 and the control console 14.

An X-ray transmissive table 22, for supporting a patient being examined, is positioned adjacent to the gantry 16. The table 22 is mounted on a support 24 in a manner that allows the table to slide between the X-ray tube assembly 18 and the X-ray detection assembly 20.

Figure 2:
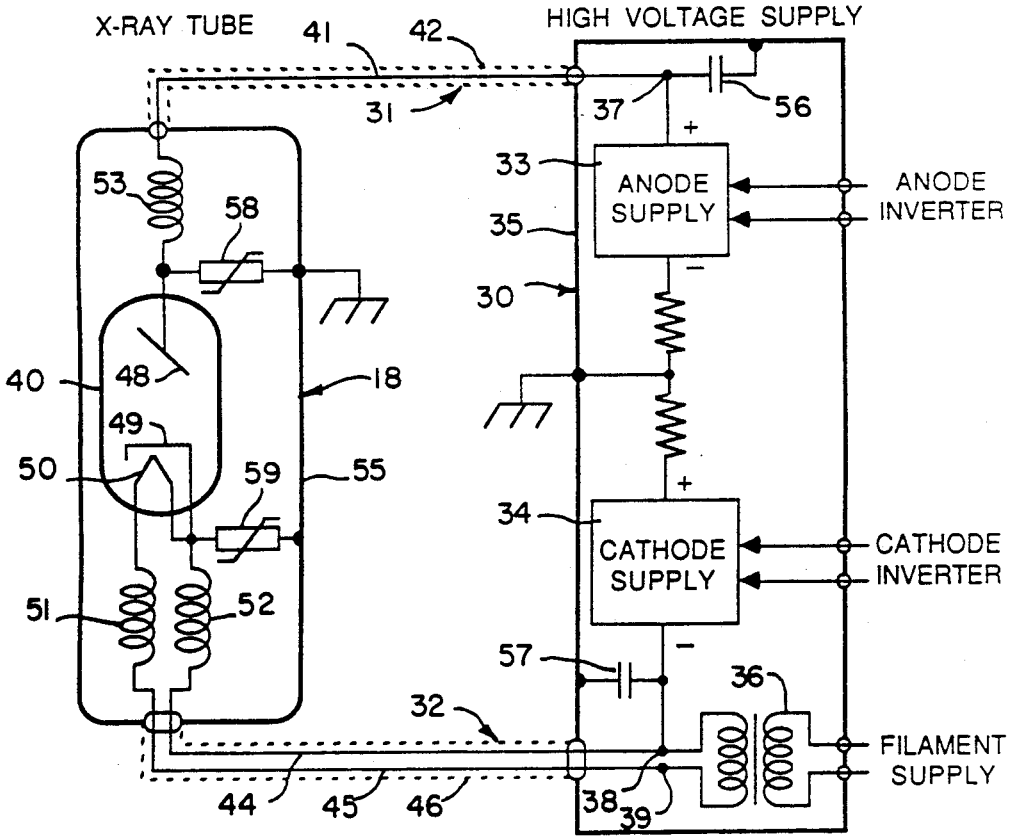
FIG. 2 is a block diagram of the high voltage supply and the X-ray tube, which have been modified according to the present invention.

FIG. 2 schematically illustrates the high voltage connection of the X-ray tube assembly 18 to a high voltage supply 30 within power supply 12 by two cables 31 and 32. The high voltage supply 30 is enclosed in a grounded conductive housing 35 and consists of several individual circuits for supplying different voltages and currents to tube assembly 18. In particular, the high voltage supply 30 includes separate anode and cathode supplies 33 and 34. The anode and cathode supplies increase voltages received from anode and cathode inverters (not shown) in the power supply 12 to produce positive and negative voltages, with respect to ground, at terminals 37 and 38, respectively. The potential difference across terminals 37 and 38 is between 40,000 and 150,000 volts, for example. The high voltage supply 30 also receives current from a filament supply (not shown) and has a transformer 40 which couples the filament current to terminals 38 and 39.

The two high voltage cables 31 and 32 have one or more center conductors 41, 44 and 45 surrounded by high voltage insulation and a grounded conductive shield 42 and 46. Each cable has a characteristic impedance of 42 ohms and an intrinsic capacitance of fifty pico farads per foot, for example. At one end of the anode cable 31, center conductor 41 is connected to terminal 37 of the anode supply 33 and the cable shield 42 is attached to the grounded housing 35 of the high voltage supply 30. The cathode cable 32 includes a first center conductor 44 connected at one end to terminal 38 of the high voltage supply 30 to receive a common negative cathode potential. A second center conductor 45 of the cathode cable 32 is connected to terminal 39 so that the two center conductors of the cable carry the filament current. The shield 46 of the cathode cable 32 is grounded by a connection to housing 35. In other X-ray systems, separate conductors are used to carry the filament current and cathode potential. Other conductors can be provided to carry bias potentials to a grid or additional filaments, as well as to carry signals for other components of the X-ray tube assembly 18.

The X-ray tube assembly 18 contains an X-ray tube 40 with an anode 48, cathode 49 and a filament 50 separated by a vacuum gap. The cathode cable 32 is coupled to the X-ray tube 40 by a pair of air core inductors 51 or 52. Each inductor 51 and 52 couples one of the center conductors 44 or 45 of the cathode cable 32 to opposite ends of the filament 50 to apply current from transformer 36 through the filament. These two inductors 51 and 52 are wound in a bifilar manner to pass the filament current relatively unimpeded while still presenting an impedance to the current from a spit discharge. Thus the coupled inductors provide an advantage over termination resistors.

The center conductor 41 of the anode cable 31 is coupled by a third air core inductor 53 to the anode 48. Each of the three inductors has a value of fifteen micro henries, for example. The value of inductance controls the peak current and is adjusted to give the fastest seasoning. The inductors used when the X-ray tube 40 is placed in an imaging apparatus have an inductance chosen for prolonged tube life.

If separate conductors are provided in the cathode cable 32 for the cathode potential and the filament current, or if another conductor is included for grid electrode bias, additional inductors couple these conductors to the tube components.

A first voltage limiter, such as a metal oxide varistor (MOV) 58 is connected between the anode 48 and the grounded casing 55 of the X-ray tube assembly 18. A second voltage limiter, metal oxide varistor 59 is connected between the cathode 49 and the grounded casing 55. The voltage limiters provide shunt paths to ground when the voltage across the anode and cathode exceeds the normal operating voltage by a defined amount, for example a voltage in excess of 180,000 volts. In practice it may be difficult to provide a single MOV with such a high voltage rating, in which case a number of lower voltage rated devices are connected in series to achieve the desired rating. The two voltage limiters restrict ringing of the voltage on cables 31 and 32 due to the interaction of inductors 51–53 and the intrinsic capacitance of the cables from damaging the tube, inductors and cables. Other devices such as a spark gap, a Zener diode or a snubber circuit can be used in place of metal oxide varistors 58 and 59 as the anode to cathode voltage limiter means.

Each inductor 51–53 has the effect of stabilizing the discharge arc that occurs during a tube spit. As the arc voltage changes, the voltage across each inductor varies to whatever level is necessary to instantaneously maintain a constant current. Since the inductors 51–53 cannot dissipate energy and have no stored energy at the beginning and the end of the discharge, the amount of energy ($E_c$) that is dissipated in the arc can be precisely controlled by the voltage (V) and capacitance (C) presented to the tube assembly by the cables. The amount of energy is defined according to the relationship $E_c = 0.5\ CV^2$. Additional discrete capacitors 56 and 57 can be placed in parallel with the cable to adjust the capacitance. For example, more energy may be required at the operating voltage to initiate a spit during later stages of the seasoning process when electrode roughness is less pronounced.

The present invention has particular use during the seasoning of the X-ray tube. In this part of the manufacturing process, a new X-ray tube 40 is placed into a insulating oil bath and operated to intentionally produce spitting. The spit discharges smooth the electrodes 48 and 49 by vaporizing any foreign particles and surface roughness that can cause intense field gradients. The seasoning continues until the electrodes have been smoothed to such an extent that discharges no longer occur. During the seasoning process the inductors coupling the high voltage cables to the X-ray tube limit the energy of the discharge preventing too much electrode material from being removed and the formation of craters.

If, the discharge arc extinguishes while there is still current in the inductor, the stored energy causes the voltage across the inductor to rise until a voltage breakdown occurs. Normally this would restrike the arc in the tube, but it could breakdown the insulation of the tube or the inductor. To insure that this does not happen, the voltage limiters 58 and 59 are connected between the anode and cathode of the tube. The voltage limiters 58 and 59, by limiting the potential between the cable conductors and ground, also suppress any ringing in the cables due to interaction between the inductance and the cables' intrinsic capacitance. Thus the primary motivation previously for not coupling inductance to these high voltage cables is eliminated by the use of voltage limiters.

The inductors 51–53 and current limiters 58 and 59 are not only used in the seasoning system, but also in the X-ray imaging apparatus 10, shown in FIGS. 1 and 2. The latter usage minimizes the adverse effects from spits that occur during normal operation as the X-ray tube. The inductors reduce the severity of spit discharges. Thus the useful life of the X-ray tube is prolonged and components associated with the tube are not subjected to as extreme discharge currents. The voltage limiters in the imaging system tube assembly 18 prevent excessively high ringing voltages.

The usage of anode and cathode inductors as shown in FIG. 2 has a further advantage not directly related to tube seasoning. Observations have shown a significant reduction in the level of electrical noise during a spit. This reduction is attributed to L-C low pass filtering due to the inductors working against the cable capacitance to confine most of the noise to the grounded X-ray tube casing 55.

I claim:

1. An X-ray imaging system comprising:

a vacuum tube for emitting an X-ray beam and having an anode and a cathode;

a power supply that produces a DC voltage across a pair of terminals;

a cable means for applying the DC voltage from said power supply to said vacuum tube, said cable means having a first conductor connected to one of the terminals to apply a voltage to the anode and having a second conductor connected to the other terminal to apply a voltage to the cathode;

a first inductor connected between the first conductor and the anode; and a second inductor connected between the second conductor and the cathode;

said inductors for depressing transient currents flowing through said vacuum tube under a breakdown condition.

2. The X-ray imaging system as recited in claim 1 further comprising means, coupled between the anode and the cathode, for limiting the voltage across the anode and cathode to below a given level.

3. The X-ray imaging system as recited in claim 1 further comprising first and second voltage limiters wherein the first voltage limiter is coupled between the anode and ground and second voltage limiter is coupled between the cathode and ground.

4. The X-ray imaging system as recited in claim 3 wherein said first and second voltage limiters each comprise a metal oxide varistor.

5. The X-ray imaging system as recited in claim 3 further comprising a capacitance coupled between the first and second conductors of said cable to alter the energy (E) of a discharge in the tube to a desired value according to the relationship $E=0.5\ C\ V^2$, where C is the sum of an intrinsic capacitance of the cables and the capacitance coupled to the cables, and V is the voltage across the conductors to which the capacitance is coupled.

6. An X-ray imaging system comprising:

a vacuum tube for emitting X-rays and including a cathode, an anode and a filament;

an electrically conductive casing surrounding said vacuum tube and coupled to ground potential;

a power supply including a high voltage supply and a filament current supply;

a first cable having a central conductor for coupling the high voltage supply to the anode, and having a grounded shield surrounding the central conductor and connected to said conductive casing;

a second cable having a plurality of conductors for coupling the high voltage supply and the filament current supply to the cathode and filament, and having a grounded shield surrounding the plurality of conductors;

a first inductor within said casing and connected between the central conductor of said first cable and the anode; and a plurality of additional inductors within said casing, each one of which connected between a different one of the plurality of conductors in said second cable and a component of said vacuum tube;

each of the inductors for suppressing transient currents flowing through said vacuum tube during a breakdown condition while allowing the application of a DC excitation potential and filament current to said vacuum tube.

7. The X-ray imaging system as recited in claim 6 wherein:

said power supply comprises a first source of a positive potential with respect to ground, a second source of a negative potential with respect to ground, and a third source of a filament current;

the central conductor of said first cable coupled in series with said first inductor between said first source and then anode;

one conductor of said second cable is connected at one end to said second and third sources, and is coupled at another end by one of the plurality of additional inductors to both the filament and the cathode; and another conductor of said second cable is connected at one end to said third source and is coupled at another end by another one of the plurality of additional inductors to the filament.

8. The X-ray imaging system as recited in claim 6 further comprising means for limiting the voltage across the anode and cathode to below a given level.

9. The X-ray imaging system as recited in claim 8 wherein said means for limiting the voltage comprise a first metal oxide varistor connected between said casing and the anode; and a second metal oxide varistor connected between said casing and the cathode.

10. The X-ray imaging system as recited in claim 6 wherein all of said inductors are within said casing.

11. An X-ray tube assembly for an imaging system comprising:

a vacuum tube for emitting X-rays and including a cathode, an anode and a filament;

a conductive casing enclosing said vacuum tube;

a first inductor within said casing and connected to the anode and having a terminal for coupling to a first conductor from a high voltage supply;

a second inductor within said casing and connected to the cathode and having a terminal for coupling to a second conductor from a high voltage supply; and a third inductor within said casing and connected to the filament and having a terminal for coupling to a third conductor which carries a filament current;

each of the inductors for suppressing transient currents flowing through said vacuum tube during a breakdown condition.

12. The X-ray imaging system a recited in claim 11 further comprising means for limiting the voltage across the anode and cathode to below a given level.

13. The X-ray imaging system as recited in claim 12 wherein said means for limiting the voltage comprise a first metal oxide varistor connected between said casing and the anode; and a second metal oxide varistor connected between said casing and the cathode.

* * * * *